United States Patent [19]

Hamilton et al.

[11] 3,934,945

[45] Jan. 27, 1976

[54] DRILL ROD STABILIZATION MEANS

[75] Inventors: William H. Hamilton, Seattle; William D. Coski, Mercer Island, both of Wash.

[73] Assignee: Ingersoll-Rand Company, Woodcliff Lake, N.J.

[22] Filed: Oct. 3, 1974

[21] Appl. No.: 511,640

[52] U.S. Cl. ..... 308/4 A; 308/6 A

[51] Int. Cl.[2] ..... F16C 1/26

[58] Field of Search ..... 175/53; 308/4 A, 6 A

[56] References Cited

UNITED STATES PATENTS 3,361,493 2/1968 Melton ..... 308/4 A

*Primary Examiner*—M. Henson Wood, Jr.
*Assistant Examiner*—Gene A. Church
*Attorney, Agent, or Firm*—Bernard J. Murphy

[57] ABSTRACT

The means comprises a sleeve for envelopment of a substantial portion of the drill rod or drive stem of an earth boring machine to provide stabilization of the drill rod during its rotation and earth penetration. Additionally, the sleeve prevents the drill rod from undue abrasion and scoring which normally would occur from direct contact of the rod with the earth. The sleeve is non-rotatable; that is, it is carried on the drill rod by bearings to provide a stable surface within which, and upon which, the drill rod can rotate. As the drill rod moves through the earth the sleeve is carried along therewith.

14 Claims, 3 Drawing Figures

DRILL ROD STABILIZATION MEANS

This invention pertains to earth boring apparatus and in particular to drill rods used in conjunction with earth boring apparatus, such drill rods being of the type which rotate while penetrating the earth.

Earth boring apparatus of the type noted employ assemblies, such as that disclosed in U.S. Pat. No. 3,805,901, issued Apr. 23, 1974, to William D. Coski, for an "Earth Cutter Assembly." Such assemblies are used in the boring of that which are called raises, i.e., substantially vertical bore holes formed in the earth either to connect a tunnel with the earth surface or to connect adjacent tunnels.

Typically, a first pilot hole is bored vertically usually in a downward direction, by means of a small cutter fixed to the end of a drill rod or drive stem. Then a large cutterhead, for reaming of the pilot bore hole, is fixed to the drill rod or drive stem (replacing the small cutter), and then the drive stem is pulled upward, and rotated, to effect a widening of the pilot bore hole.

In these prior art practices, the drill rods are met with undue wear, scoring, and the like, in that they constantly engage the walls of the bore hole. Loose rock and rubble engage the outer circumference of the drill rod and bore hole wall and abrade, score, and otherwise damage the outside surface of the drill rod. Additionally, because of discontinuities in the bore hole and the earth walls thereof, a condition aggravated by drill rod engagement with, and rotary "crushing" of rock and rubble, the drill rod has some difficulty in maintaining true concentricity relative to its optimum or desired rotary axis. This results in ellipsing and/or widening of the bore hole and causes undue gyration of the reaming cutterhead.

It is an object of this invention, therefore, to disclose means for stabilizing the drill rod of an earth boring machine to provide for a more controlled and concentric rotation of the drill rod, as well as means for protecting the drill rod against undue wear and abrasion. It is also an object of this invention to set forth means for stabilizing the drill rod of an earth boring machine having a rotating and earth penetrating drill rod, comprising means for coupling thereof to drill rod, for interpositioning between the earth and drill rod, for engaging the earth; said earth engaging means having means for receiving a bearing means interpositionally between said earth engaging means and drill rod for accommodating relative rotation between said earth engaging means and drill rod.

A feature of this invention comprises a sleeve for envelopment of a substantial portion of the drill rod or drive stem of an earth boring machine to provide stabilization of the drill rod during its rotation and earth penetration. Additionally, the sleeve prevents the drill rod from undue abrasion and scoring which normally would occur from direct contact of the rod with the earth. The sleeve is non-rotatable that is, it is carried on the drill rod by bearings to provide a stable surface within which, and upon which, the drill rod can rotate. As the drill rod moves through the earth the sleeve is carried along therewith.

Further objects and features of the invention will become more apparent by reference to the following description taken in conjunction with the accompanying figures, in which.

Figure 1:
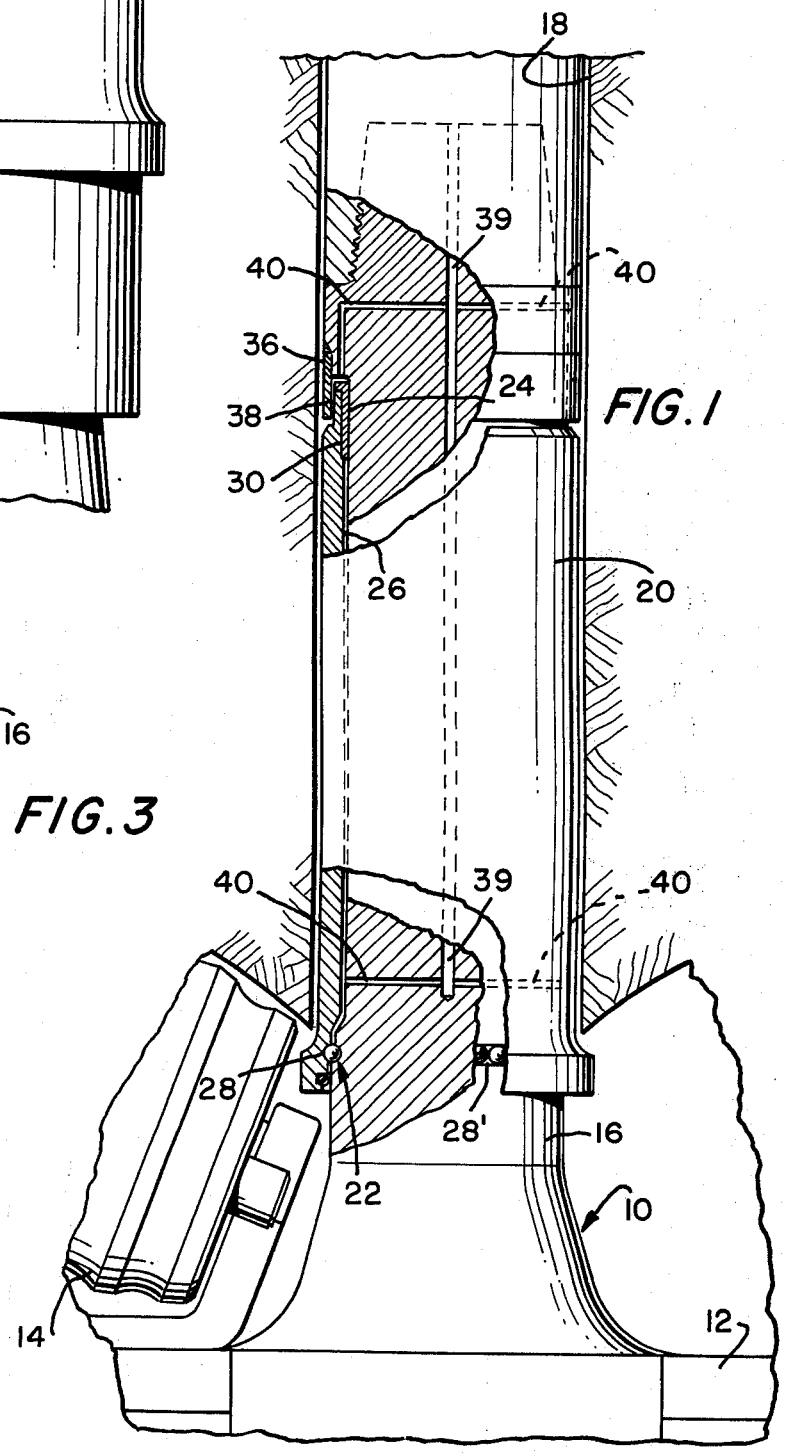
FIG. 1 is a vertical elevation, partly in cross-section depicting a raise borer type of earth cutter assembly employing an embodiment of the invention.

As shown in FIG. 1 an earth cutter assembly 10 comprises a cutterhead 12 on which are mounted a plurality of roller earth cutters 14. A drive stem 16 is fixed to the cutterhead 12 for imparting rotary torque thereto, and for moving the earth cutter assembly vertically through the earth. In accordance with the known practices, a first pilot bore 18 has been formed in the earth through which the drive stem or drill rod 16 is confined for raising the cutterhead 12.

Figure 3:
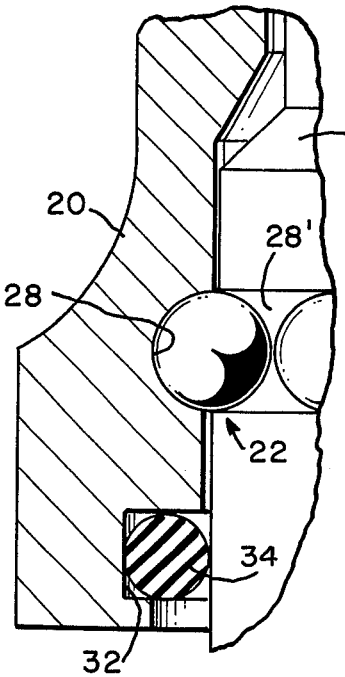
FIG. 3 is an enlarged detail, in partial cross-section, of the lowermost bearing arrangement.

About the substantial portion of the drill rod 16 is fixed sleeve 20 which is set apart, slightly, from the drill rod 16 by a pair of bearings 22 and 24 adjacent either ends thereof. The sleeve 20 has an inside circumferential surface 26 with recesses 28 and 30 formed therein to accommodate the bearings 22 and 24, respectively. The uppermost recess 30 receives the sleeve-type bearing 24, whereas the lowermost recess 28 is arcuate, the same defining the outer race of a ball bearing. The complementary interfacing surface of the drill rod 16, near the lowermost end of the sleeve 20, also has an arcuate recess 28' to define the inner race of the ball bearing. As shown in enlarged detail, in FIG. 3, recesses 28 and 28' have stepped edges to define — together with the roller elements (only one being shown) — a bearing capable of carrying both side and axial (thrust) loads.

At the lower, terminal end of the sleeve 20, an annular recess 32 is provided; recess 32 receives a seal 34 to prevent admittance of rock chips, dust, dirt and the like into the sleeve. About the upper end of the drill rod and integral therewith, is an annular shield 36. This too is provided to inhibit the entry of detritus to the uppermost bearing 24. The uppermost end of the sleeve 20 has a outer, annular recess 38 the surface of which defines an slightly spaced-apart rotary interface with the shield 36.

The novel sleeve 20, it is to be noted, is non-rotating. It slidably engages the wall of the bore hole 18 to contain the earth and to provide a bearing surface upon which, or relative to which, the drill rod 16 can rotate.

As the assembly 10 is moved axially, loose rock chips, earth rubble, and like detritus will proceed or follow behind, but little or none thereof will move into the borehole area occupied by the drill rod 16 and sleeve 20. The sleeve 20 shores up the borehole wall; as it doesn't rotate, it will not extract and circulate loose earth material. It serves somewhat the function of a hole liner, providing a substantially fixed reference for concentric rotation of the drill rod 16.

The center of the drill rod 16 has a bore 39 throughout a substantial portion thereof, and laterally-extending branch passageways 40 provide for the supply of lubricant, and coolant which may be a mixture of water and compressed air, for lubricating the bearings. Terminal end of the passageways 40 open onto the bearing 22 and 24.

Figure 2:
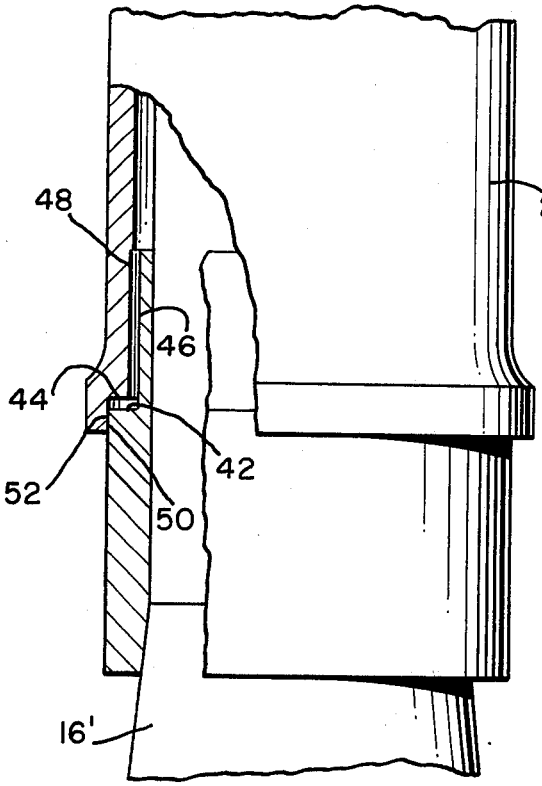
FIG. 2 is a fragmentary vertical elevation, also partly in cross-section, of an alternate bearing arrangement for the lowermost end of the drill rod stabilizing means.

FIG. 2 depicts an optional bearing arrangement for the lowermost end of a sleeve 20'. The same comprises inter-engaging annular shoulders 42 and 44 and cooperating bearing surfaces 46, 48, 50 and 52 formed in the drill rod 16' and sleeve 20', for accommodating thrust and radial loading.

While we have described our invention in connection with specific embodiments thereof, it is to be clearly understood that this is done only by way of example and not as a limitation to the scope of our invention as set forth in the objects thereof and in the appended claims.

We claim:

1. For use with an earth boring machine having a rotatable and earth penetrating drill rod, means for stabilizing the drill rod during rotation and earth penetration, comprising:

means for coupling thereof to drill rod, for interpositioning between the earth and drill rod, for engaging the earth;

said earth engaging means having means for receiving a bearing means interpositionally between said earth engaging means and drill rod for accommodating relative rotation between said earth engaging means and drill rod.

2. Drill rod stabilizing means according to claim 1, wherein:

said earth engaging means comprises means defining a bearing surface for contacting and restraining the earth and for supporting drill rod for rotation relative thereto.

3. Drill rod stabilizing means, according to claim 1, wherein:

said earth engaging means comprises an annular member having inner and outer circumferential surfaces; and said inner circumferential surface has an annular recess formed therein for receiving a bearing.

4. Drill rod stabilizing means, according to claim 1, wherein:

said earth engaging means comprises an annular member having inner and outer circumferential surfaces; and said inner circumferential surface has a plurality of spaced-apart annular recesses formed therein for receiving a bearing in each recess of said plurality.

5. Drill rod stabilizing means, according to claim 1, wherein:

said earth engaging means comprises an elongate sleeve;

said sleeve having an annular recess formed in one end thereof for nesting sealing means therewithin.

6. Drill rod stabilization means, according to claim 5, wherein:

said sleeve has an annular recess formed in another end thereof for defining a rotary interface thereat with a drill rod detritus shield.

7. In combination, a rotatable earth penetrating drill rod and means for stabilizing the drill rod during rotation and earth penetration, comprising:

means coupled to the drill rod, for interpositioning between the earth and said drill rod, for engaging the earth;

said earth engaging means having means for receiving a bearing means interpositionally between said earth engaging means and said drill rod for accommodating relative rotation between said earth engaging means and drill rod.

8. A combination, according to claim 7, wherein:

said earth engaging means comprises means defining a bearing surface for contacting and restraining the earth and for supporting said drill rod for rotation relative thereto.

9. A combination, according to claim 7, wherein:

said earth engaging means comprises an annular member having inner and outer circumferential surfaces; and said inner circumferential surface has an annular recess formed therein for receiving a bearing.

10. A combination, according to claim 7, wherein:

said earth engaging means comprises an annular member having inner and outer circumferential surfaces; and said inner circumferential surface has a plurality of spaced-apart annular recesses formed therein for receiving a bearing in each recess of said plurality.

11. A combination, according to claim 7, wherein:

said earth engaging means comprises an elongate sleeve;

said sleeve having an annular recess formed in one end thereof for nesting sealing means therewithin.

12. A combination, according to claim 11, wherein:

said drill rod has a detritus shield coupled thereto; and said sleeve has an annular recess formed in another end thereof which defines a rotary interface with said drill rod detritus shield.

13. A combination, according to claim 7, further including:

bearing means operatively interposed between said drill rod and said earth engaging means; and means for admitting lubricant to said bearing means.

14. A combination, according to claim 13, wherein:

said lubricant-admitting means comprises passageway means formed in said drill rod.

* * * * *